US005192147A

United States Patent [19]

McCloskey

[11] Patent Number: 5,192,147

[45] Date of Patent: Mar. 9, 1993

[54] NON-PYROTECHNIC RELEASE SYSTEM

[75] Inventor: Thomas E. McCloskey, San Jose, Calif.

[73] Assignee: Lockheed Missiles & Space Company, Inc., Sunnyvale, Calif.

[21] Appl. No.: 753,556

[22] Filed: Sep. 3, 1991

[51] Int. Cl.[5] ..... B25G 3/18

[52] U.S. Cl. ..... 403/322; 403/404; 285/381

[58] Field of Search ..... 403/404, 24, 322; 285/381

[56] References Cited

U.S. PATENT DOCUMENTS

| | | | |
|---|---|---|---|
| 4,391,543 | 7/1983 | Elsing | 403/24 |
| 4,596,483 | 6/1986 | Gabriel | 403/404 X |
| 4,743,079 | 5/1988 | Bloch | 403/404 X |
| 5,024,549 | 6/1991 | Dalby | 403/404 |

*Primary Examiner*—Andrew V. Kundrat
*Attorney, Agent, or Firm*—H. Donald Volk

[57] ABSTRACT

A non-pyrotechnic release system for use in satellites and other remote actuations applications is disclosed. This system employs shape memory rod assemblies to release a captive toggle that retains the item to be deployed. The shape memory rod assembly includes an internally installed resistance heating element for heating the rod to cause it to assume its memory shape.

7 Claims, 8 Drawing Sheets 1
2
3
4
5
6
7
8
10
11
12
13

FIG_12
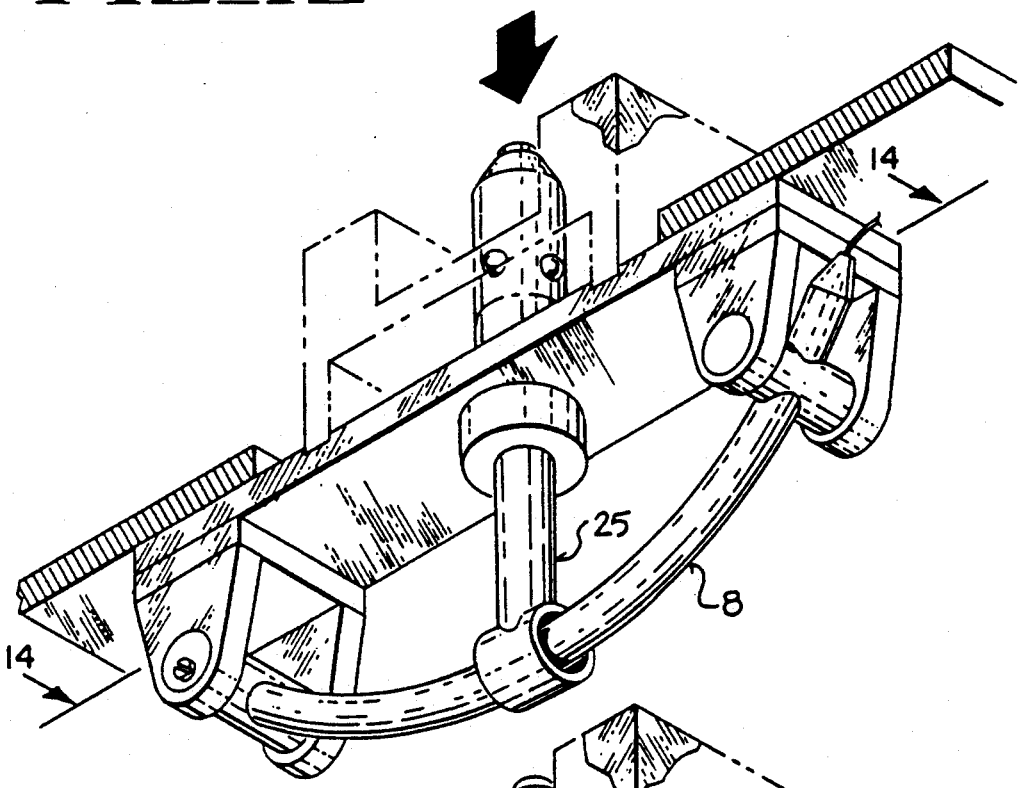
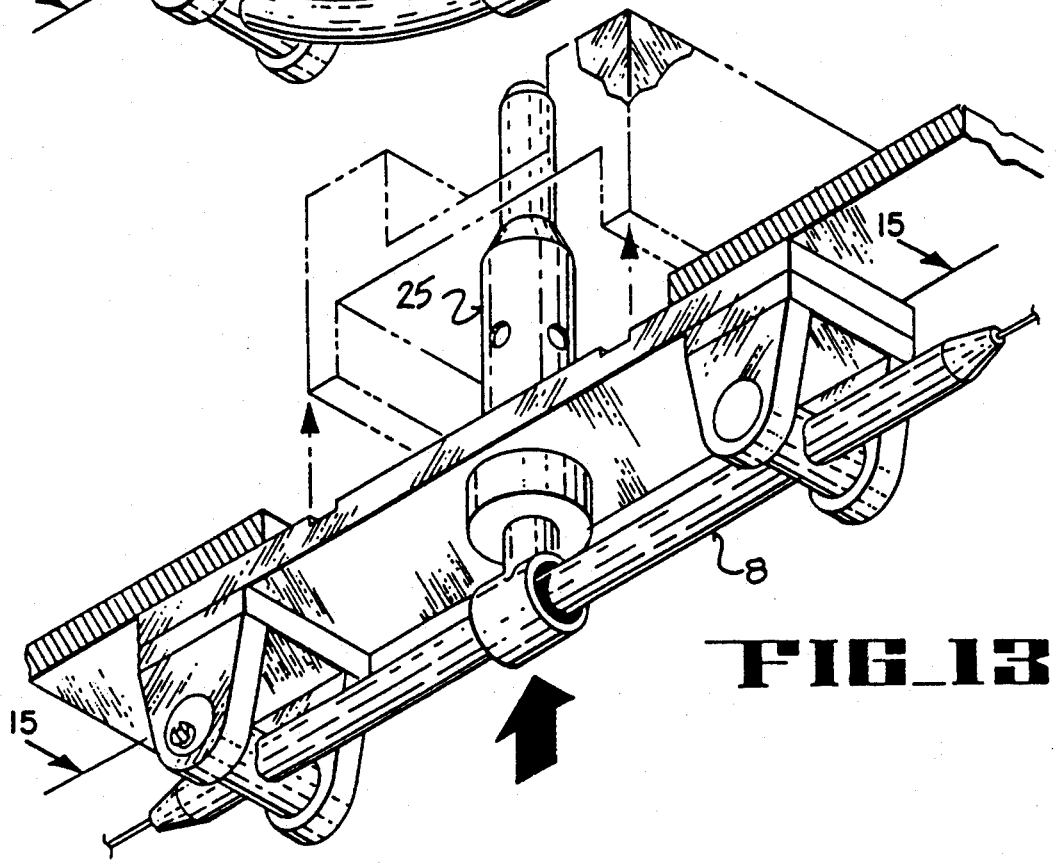
FIG_13

NON-PYROTECHNIC RELEASE SYSTEM

FIELD OF INVENTION

The present invention relates to an improved release mechanism suitable for use in satellites and other applications requiring remote actuation.

DESCRIPTION OF THE PRIOR ART

In satellites, it is often necessary to move or deploy devices, such as an antenna, from its stowed position to its operating position after the orbital vehicle has reached its intended orbit. For example, antennas and antenna booms are usually stored and securely restrained during the launch. After the orbital vehicle achieves the desired orbital position, the release devices are then remotely activated, releasing the stowed antenna or boom. Traditionally, antennas and the like have been retained by pyrotechnic pin pullers and other shock producing devices which in turn are activated so as to pull a pin, cut a bolt or otherwise disengage a retainment feature. These pyrotechnic devices suffer from a number of disadvantages. They induce a large shock load into the item being released, and also into adjacent mechanisms and electronics. Moreover, the byproduct of the pyrotechnic explosion could contaminate the delicate instruments and other circuits in satellite.

Other problems with pyrotechnic devices are their inherent safety requirements, non-recyclability, and lack of capability to be functionally tested prior to use. So, in turn, one must rely solely upon statistical and random-lot testing methods to verify that the actual device and its pyrotechnic initiator that is used will perform its intended function. To assure that the device or mechanism is properly released or unlatched for a deployment sequence, it is normally required that redundancy is built into the release system, so as to not have, what is called, "a single point failure". To design for this it is normally the practice that a second pyrotechnic device is designed into the system and which is frequently placed adjacent to the primary unit which allows either one or both pyrotechnic devices to release the deployable mechanism. This of course, increases the safety requirements, cost, weight, and overall complexity of a pyrotechnic release system.

SUMMARY OF THE PRESENT INVENTION

The present invention is directed to a non-pyrotechnic release system. Specifically the present invention utilizes two mechanically conditioned bent rod assemblies made of a shape memory alloy that is used as a retainer and both, as generator of force and motion to release a captured preloaded toggle. Activating the rod assembly's internally installed resistance heating element will cause the rod to heat up to an intermediate temperature above the materials crystalline phase transformation temperature, causing the rod to seek its intermediate configuration or memory shape, which in this case is a straight rod, releasing the captured toggle and allowing the retained device to deploy. This non-pyrotechnic release system will induce little or no shock load to adjacent equipment along with being non-contaminating. This release device, along with being non-pyrotechnic, is also functionally testable, and provides a weight savings.

BRIEF DESCRIPTION OF THE DRAWINGS

FIG. 12 is a prospective view of the third embodiment of the present invention showing the mechanism in the retaining position.

FIG. 13 is a prospective view of the third embodiment of the present invention showing the mechanism in the released position.

DETAILED DESCRIPTION OF THE INVENTION

The present invention will now be disclosed in detail with reference to the figures.

Figures 1, 2, 3:
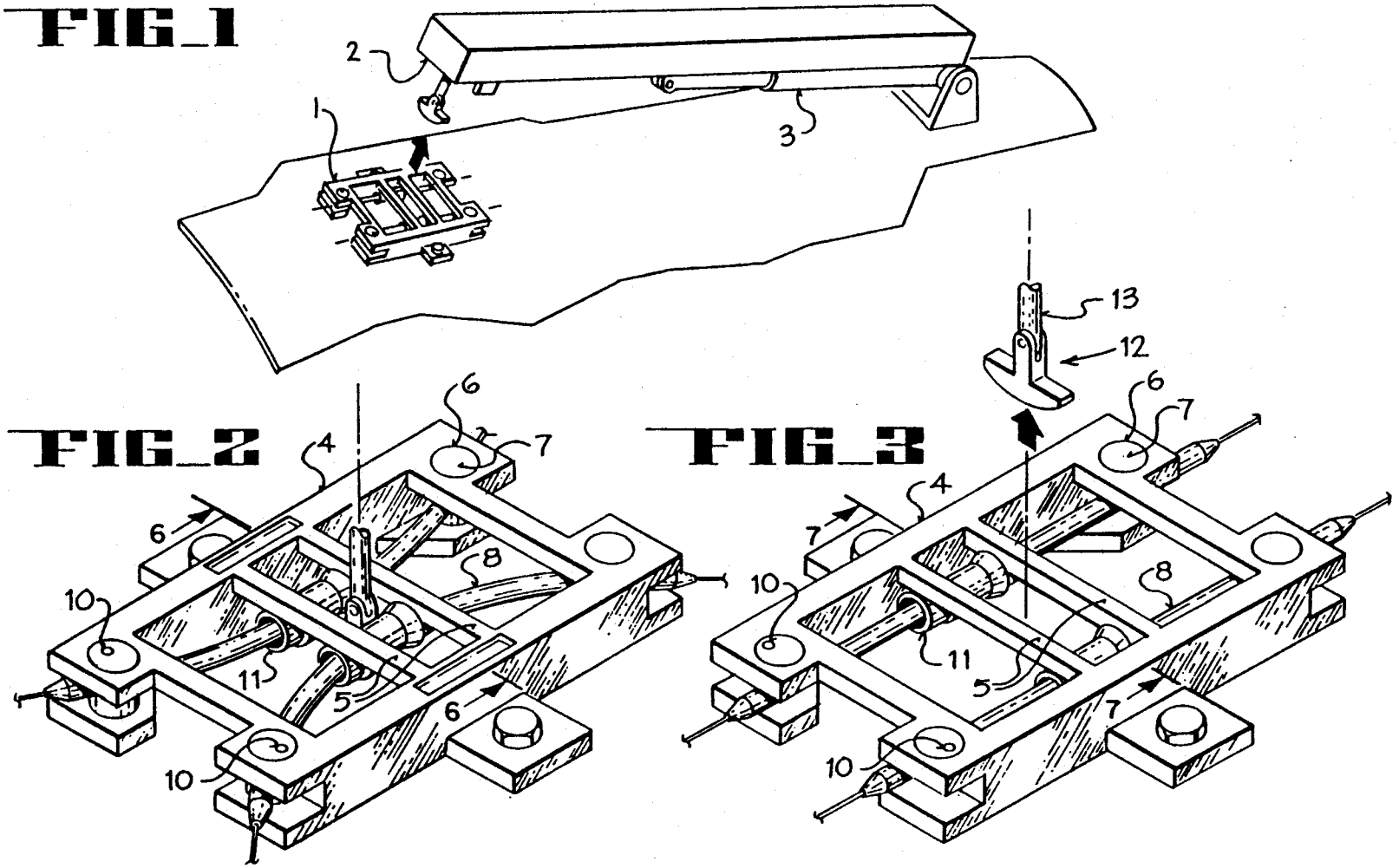
FIG. 1 is a broken-away overall view of a representative release system embodying the present invention.
FIG. 2 is one embodiment of the non-pyrotechnic release system of the present invention in the retaining position.
FIG. 3 is the embodiment of the present invention of FIG. 1 in the released position.

FIG. 1 shows one embodiment of the release mechanism 1 of the present invention being utilized to restrain a deployable device 2 during the launch of a satellite. As shown, the deployable device 2 has just been released by the release mechanism 1 and is being pivoted into the desired deployed position by a hydraulic or spring loaded cylinder 3.

Figure 7:
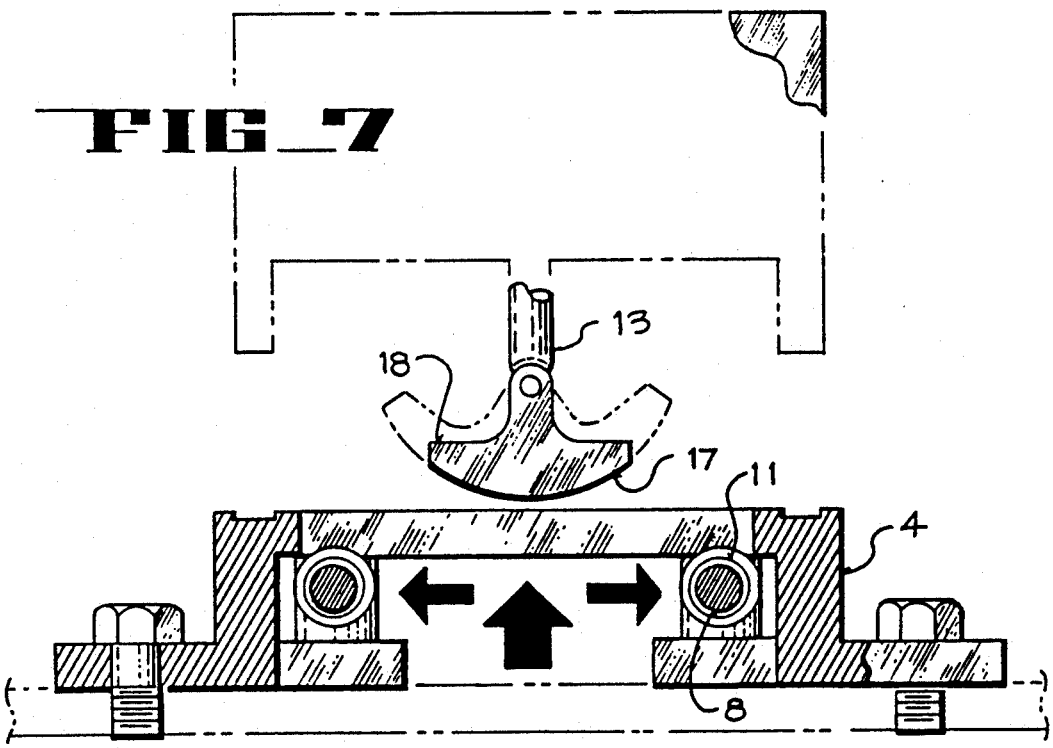
FIG. 7 is a sectional view of embodiment of FIG. 4 showing the mechanism in the released position.
Figure 9:
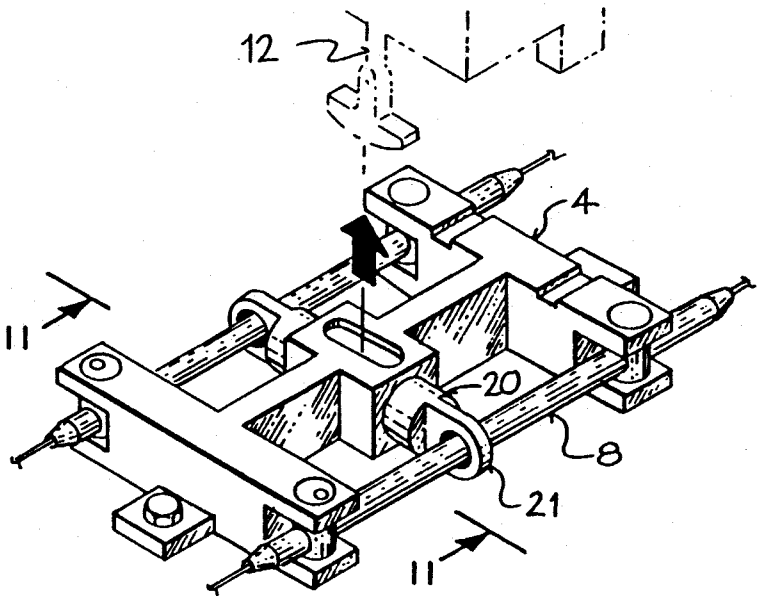
FIG. 9 is a prospective view of the second embodiment of the present invention showing the mechanism in the released position.
Figure 8:
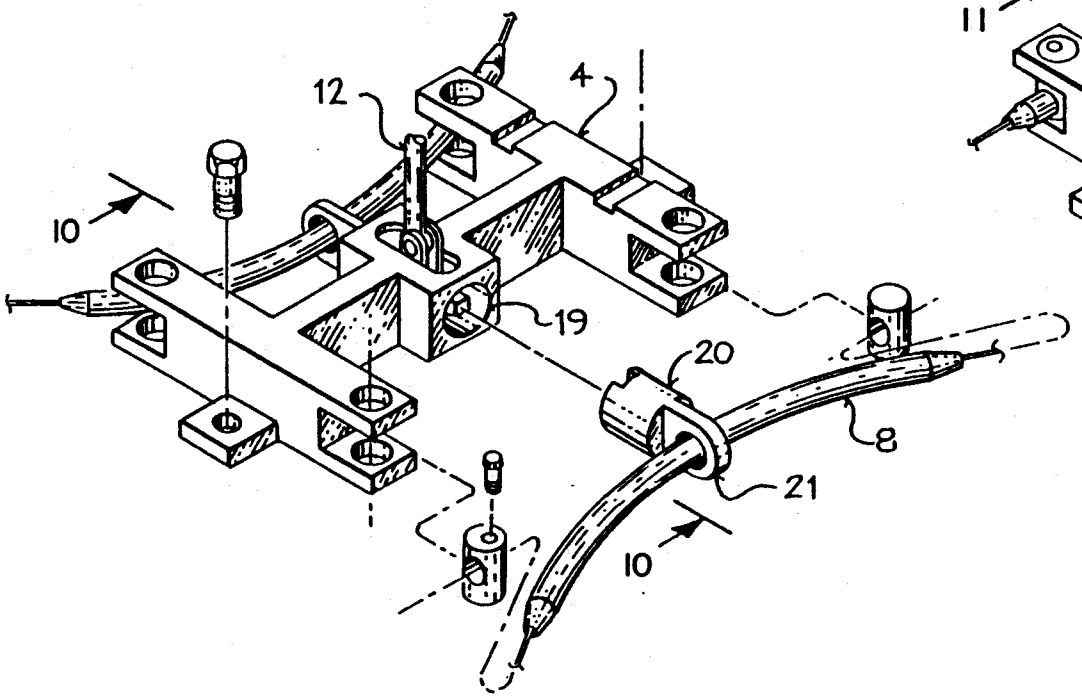
FIG. 8 is a partial exploded view of a second embodiment of the present invention.
Figure 10:
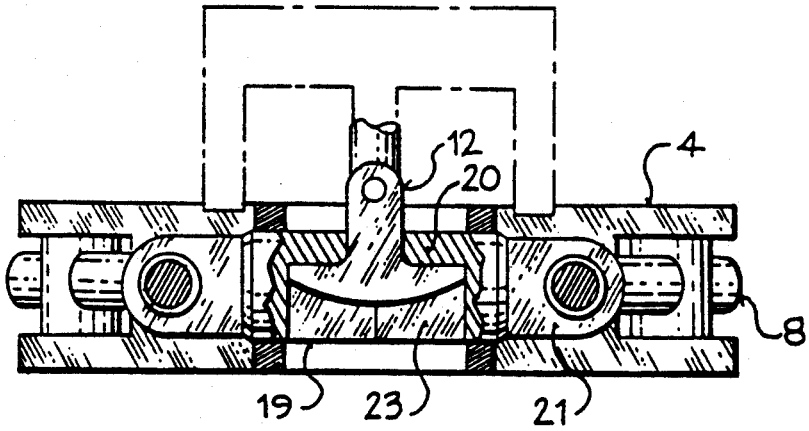
FIG. 10 is a sectional view of embodiment of FIG. 9 showing details of the retention mechanism.
Figure 11:
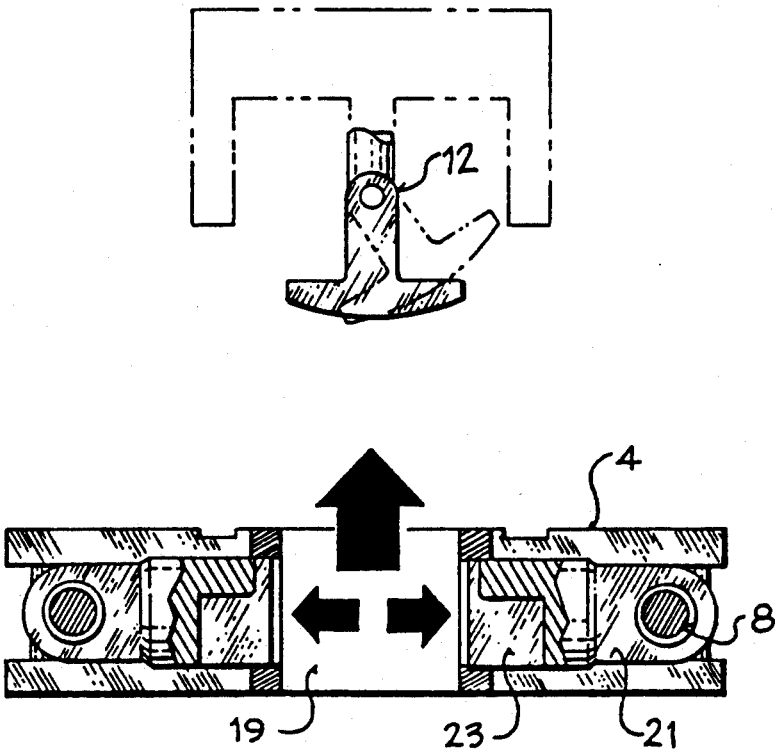
FIG. 11 is a sectional view of embodiment of FIG. 9 showing the mechanism in the released position.
Figure 14:
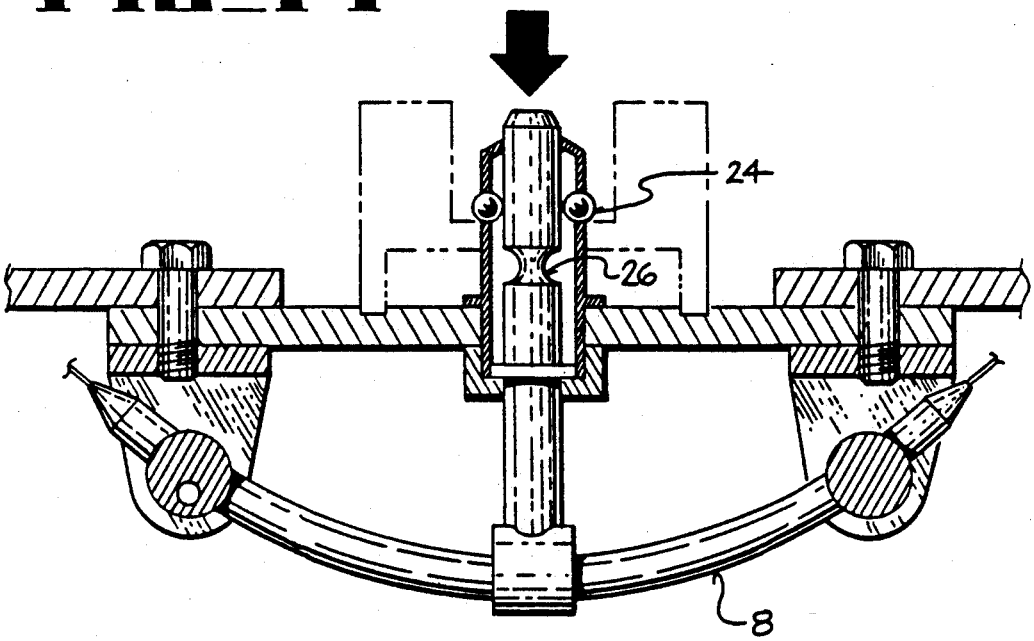
FIG. 14 is a sectional view of embodiment of FIG. 12 taken along line 14–14 of FIG. 12.

The operation of the release mechanism 1 shown in FIG. 1 will be better understood with reference to FIGS. 2, through 7.

The Release System includes a frame 4. The frame 4 includes a pair of cross members 5 approximately at the center of the longitudinal dimension of the frame 4. The four extremities of the frame form four bores 6. A bushing 7 is rotatively mounted within each bore 6 and is retained therein by a shape memory alloy rod assembly 8. A cylindrical bore 9 is included in the bushing 7 and two of the bushings also include a rod retention screw or pin 10. A shape memory alloy rod assembly 8 is inseted throught the bore 9 in the bushing 7 and is restrained from lateral movement on one end by the rod retention screw 10 engagement to the notch in the rod. The other end of the rod assembly is free to slide within the other bushing's bore. This bushing is free to pivot within its bore.

A loose fitting sleeve 11 that includes shoulders 30 is centrally mounted on the shape memory alloy rod assembly 8 and is retained from sliding along the rod assembly 8 by the shoulders 30 that are captured between the two frame cross members 5. A pivoting toggle assembly 12 engages and is captured between the rod sleeves while the rods 8 are in their bent configuration. The toggle assembly's threaded shaft 13 engages with the stowed mechanism. Tension is maintained on the toggle 13 by the deployable device 2 and a preloaded cylinder 3 (see figure 1). This tension draws the rod sleeves 11 against the frame cross members transferring the load through the frame 4 and back to the stowed mechanism completing a load path.

Figures 4, 5:
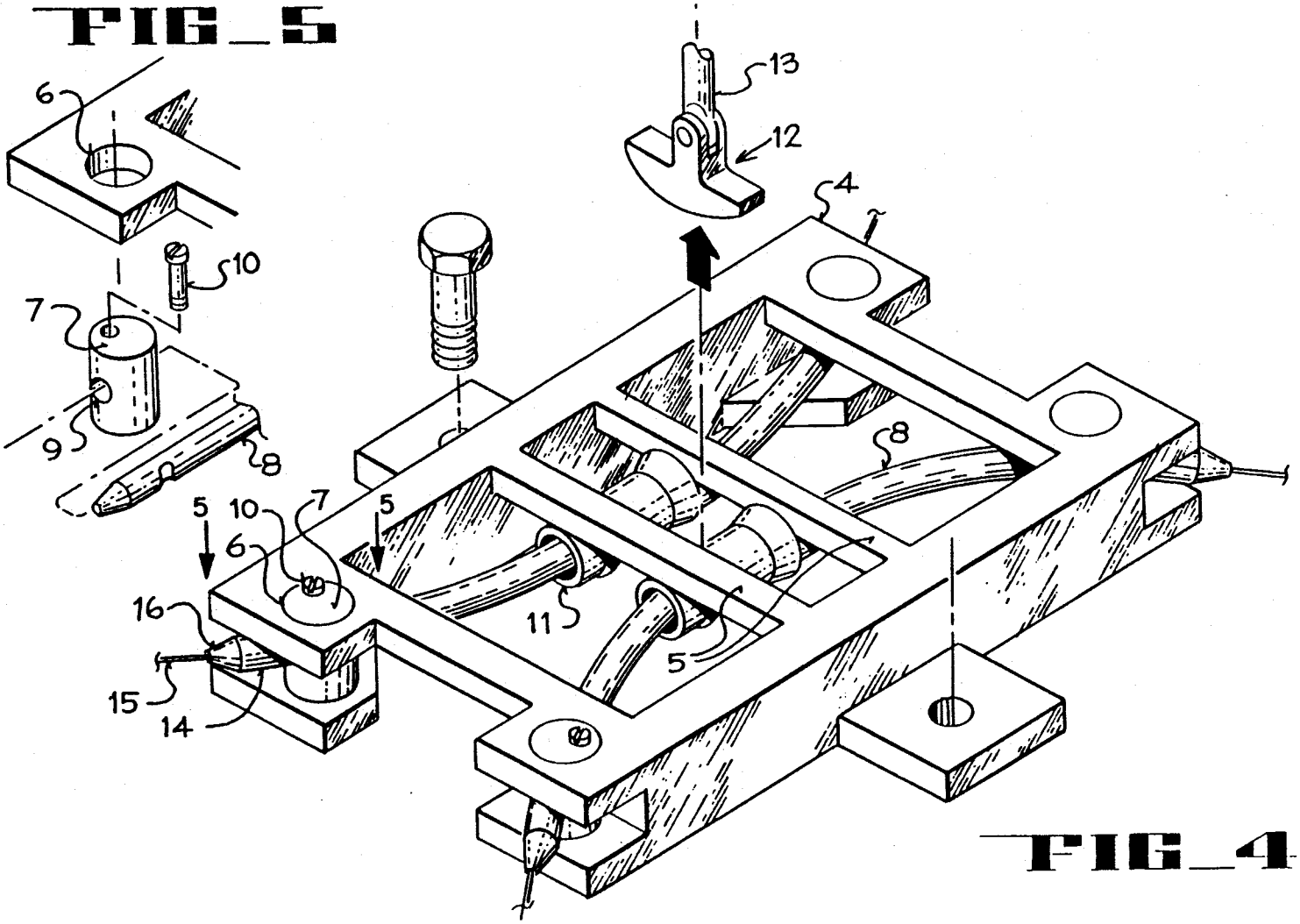
FIG. 4 is an isometric view of the embodiment of FIG. 1 showing the non-pyrotechnic release system in detail.
FIG. 5 is a detailed sectional view of FIG. 4 illustrating the retention mechanism for the rod assembly.

Referring now to FIG. 4, the rod assembly 8 includes a cylindrical shaped titanium-nickel base alloy rod 14 having shape change memory properties. Such an alloy is disclosed in U.S. Pat. No. 4,304,613 to Wang, et al. A heating element 15 extends the length of the titanium-nickel base alloy rod and extends beyond the ends thereof and is adapted for receiving an electrical current from a current source, not shown. The heating element is retained within the rod by rubber encapsulation compound 16 or any other well known means.

Figure 6:
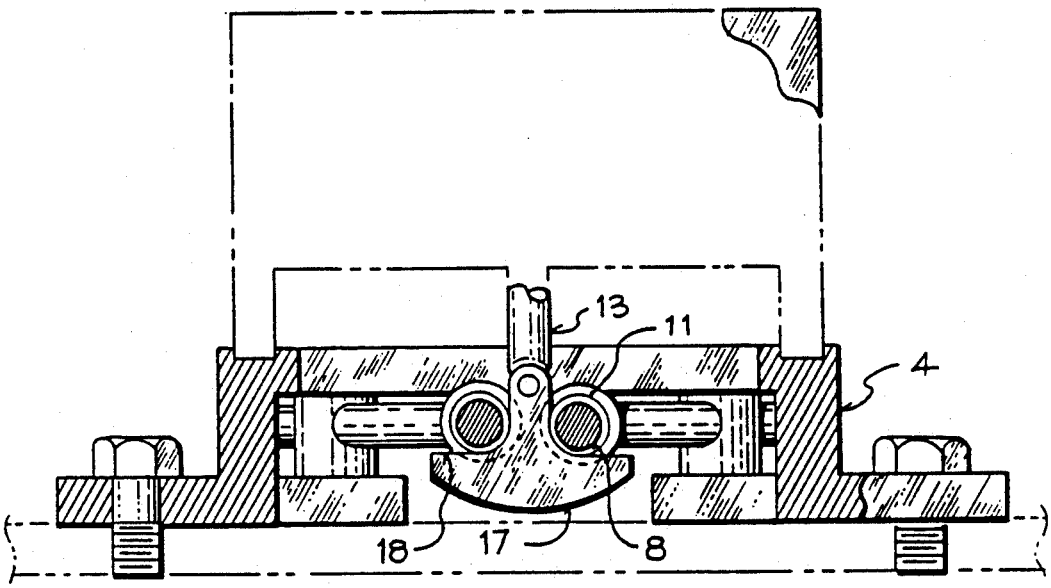
FIG. 6 is a sectional view of embodiment of FIG. 4 showing the mechanism in the retained position.

The alloy rod 14 is treated such that it takes an arch shape in its cool or normal state and a straight shape when it is heated. When the rod assembly 8 changes its shape, the center sleeve 11 on the rod assembly 8 is guided by the frame cross members 5. One end of the rod, which is retained by the rod retention screw 10, is free to rotate with the pivot bushing 7. The other end of the rod assembly 8 is free to slide within the other bushing 7 when it is changing its shape. Thus, the center sleeve 11 on both rod assemblies 8 open and close between the frame cross members 5 in a controlled fashion. The detailed operation of the releasing sequence will be better understood with reference to FIGS. 6 and 7. FIG. 6, which is a sectional view of FIG. 5, shows the mechanism in the retained position. FIG. 7 shows the operation of the toggle 17 when the mechanism is released. A threaded shaft 13 connects the pivotable toggle 17 to the deploy device. In the retained position, the protruding ears 18 of the toggle 17 are held captive by the sleeves 11 mounted on the Shape Memory Alloy rod assemblies 8. When it is desired to release the deploy device, a current is applied to the heating element 15 within the rod assembly 8. This causes the shape memory alloy rods 14 to heat and to transform to its heated state, that is to change its shape from curve to straight. This straightening of the rod assemblies 8 carries the captive rollers 11 towards the outward edge of the frame 4, which in turn allows the toggle 17 to release when it has cleared the rollers 11. The toggle is pivotably mounted so that it can pivot and clear a captive roller in the event of the failure of one of the shape memory alloy rods 8. In other words, if one of the shape alloy rod assemblies fails to change from its curved state to its straight state, the toggle 17 can pivot, shown in FIG. 7 thus allowing the deploy device to be released making this device fully redundant.

FIGS. 8–11 show another embodiment of the present invention. In this embodiment, the mounting of the rod assemblies 8 on the frame 4 is similar to the structures described in the embodiment shown in FIGS. 1–7. In this embodiment, the frame 4 includes a slotted cylindrical bore 19 approximately midway between the rod assembly support members. Slideably mounted on each of the rod assemblies 8 is a piston 20, that includes a tab 21 defining a bore 22. The rod assembly 8 is slideably mounted through the bore 22.

The inboard end of the piston 20 includes an axially aligned elongated slot 23 adapted to receive the toggle assembly 12. As can be seen from the figures, the slots for the toggle assembly retains the toggle assembly 12 captive when the pistons 20 are in their inboard positions.

Figure 15:
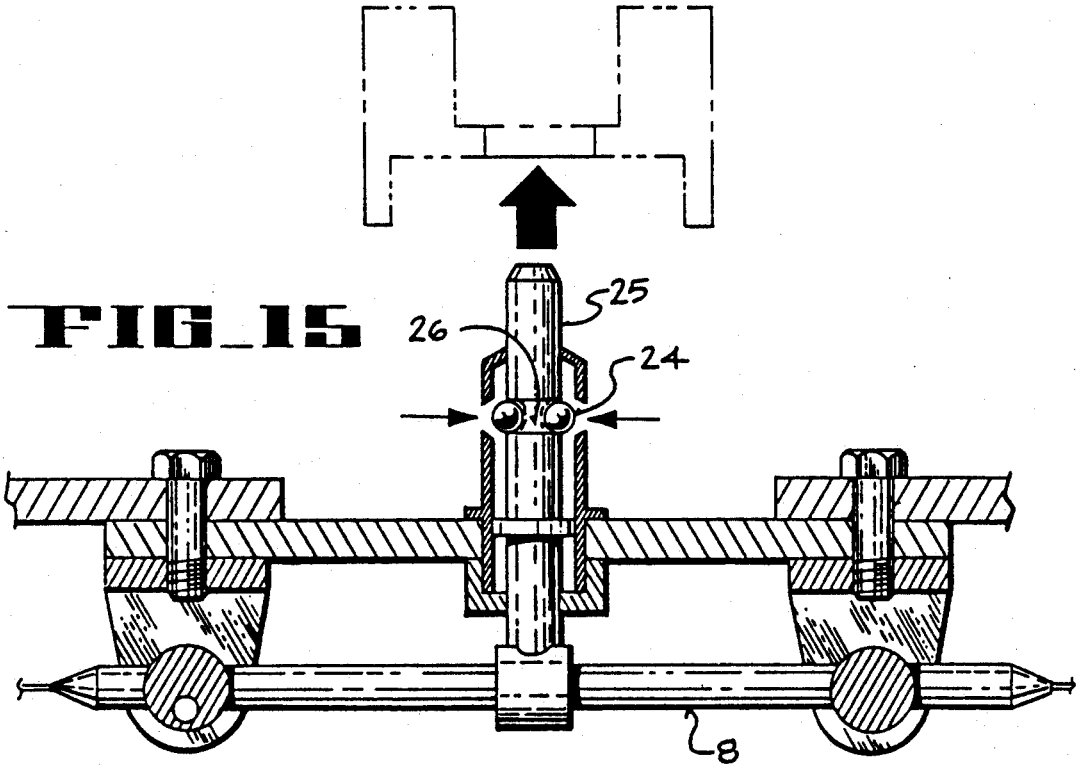
FIG. 15 is a sectional view taken along line 15—15 of FIG.13.

FIGS. 12–15 show another embodiment of the present invention. As can be understood with reference to the figures, a single rod assembly 8 is utilized to control a captive ball system 24. When the rod assembly 8 is heated, the rod assembly 8 changes from an arch shape to a straight shape, thus pushing captive piston 25 in the direction of the frame 4 as shown in FIG. 15. When the slot 26 in the captive piston 25 is aligned with the captive balls 24, they retract and the retained or stowed element is released.

Figure 16:
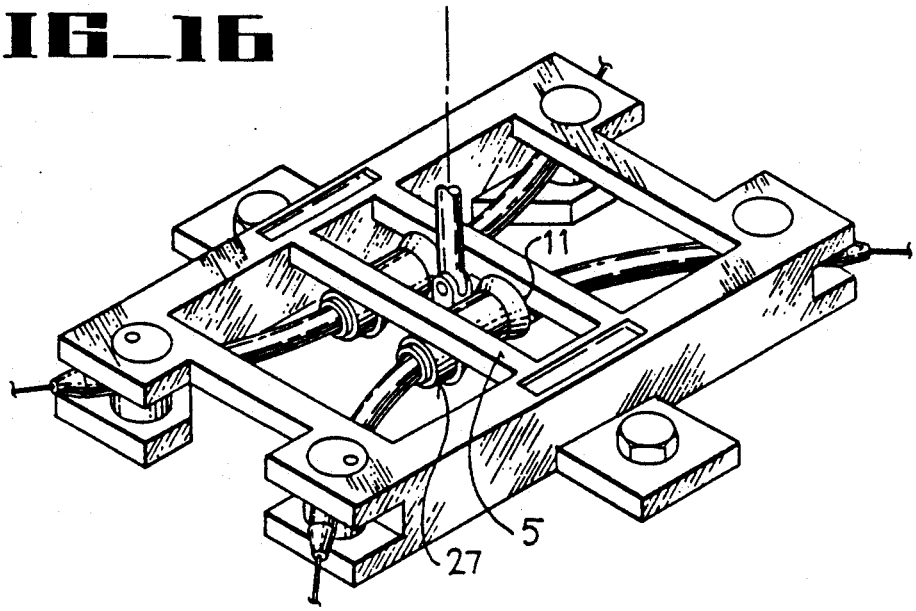
FIG. 16 is a prospective view of another embodiment of the release system of FIG. 2 that includes bearing means.
Figure 17:
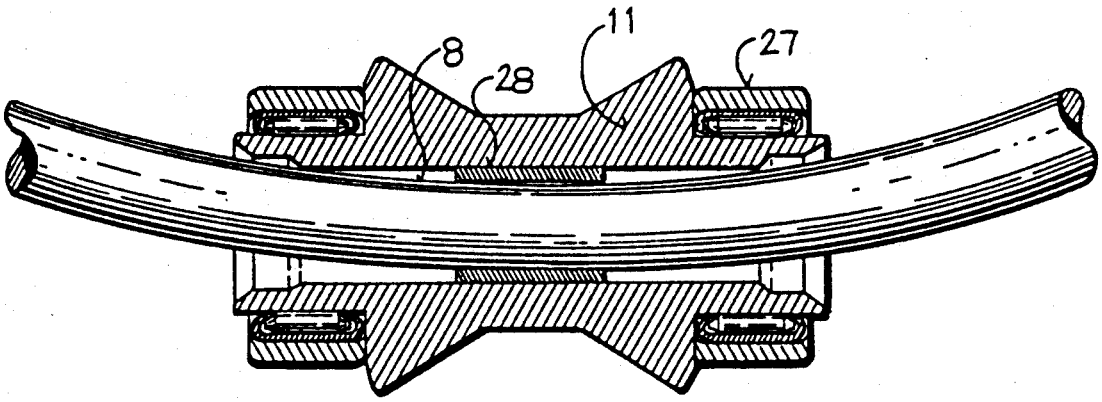
FIG. 17 is a partial sectional view of the embodiment of FIG. 16 showing the details of sleeve assembly.

FIGS. 16 and 17 show details of another embodiment of the present invention shown in FIGS. 1–7. In this embodiment the sleeve 11 includes a pair of roller bearings 27 that ride against the cross members 5 along with an internal sleeve bearing 28 that rides against the rod assembly 8. The ends of the bore are relieved for rod clearance.

Other modifications and advantageous applications of this invention will be apparent to those having ordinary skill in the art. Therefore, it is intended that the matter contained in the forgoing description and the accompanying drawings is illustrative and not limitative, the scope of the invention being defined by the appended claims.

I claim:

1. A pyrotechnic free release system comprising at least one shape memory rod assembly, said rod assembly having a first shape at normal temperatures and a second shape when heated to an elevated temperature, means for retaining one end of the rod assembly for rotatable movement and means for retaining the other end of the rod assembly for rotatable movement and sliding movement, a toggle assembly, said toggle assembly including a shaft and a pivoting toggle, means mounted on said shape memory rod assembly for selectively retaining and releasing said pivoting toggle.

2. The pyrotechnic free release system of claim 1 further defined as including two shape memory rod assemblies, said shape rod memory assemblies mounted on opposite sides of said pivoting toggle.

3. The pyrotechnic free release system of claim 2 wherein said means for retaining the rod assembly for rotatable movement including a frame, said frame including a longitudinal cross member, a bore in said frame, a bushing rotatably mounted in said bore, a transverse cylindrical bore in said bushing adapted to receive said shape memory rod unit, and means connected to said bushing to restrain said rod assembly from sliding movement, said mean for retaining the other end of the rod assembly for rotatable movement including a second bore in said frame, a second bushing rotatably mounted in said bore, a transverse cylindrical bore in said second bushing adapted to receive said memory rod unit and restraining said memory rod unit for ratatable movement with and sliding movement within the bushing.

4. The pyrotechnic free release system of claim 3 further defined as including a frame, said frame including a pair of cross members, said shape memory rod units mounted below said cross members, a loose fitting sleeve mounted on each of said shape memory rod units and adapted for sliding movement along said cross members in response to the change of shape of said shape memory assemblies.

5. The pyrotechnic free release system of claim 3 further defined as including a frame, said frame including a pair of cross members, said shape memory rod units each including a fitted sleeve adapted for sliding engagement with said cross members when the shape memory rod changes shape, said fitted sleeve further defined as including roller bearings and sleeve bearing.

6. The pyrotechnic free release system of claim 2 wherein said means for retaining the rod assembly for rotatable movement including a frame, said frame including a longitudinal cross member, a bore in said frame, a bushing rotatably mounted in said bore, a transverse cylindrical bore in said bushing adapted to receive said shape memory rod unit, and means connected to said bushing to restrain said rod assembly from sliding movement, said mean for retaining the other end of the rod assembly for rotatable movement including a second bore in said frame, a second bushing rotatably mounted in said bore, a transverse cylindrical bore in said second bushing adapted to receive said memory rod unit and restraining said memory rod unit for rotatable movement with and sliding movement within the bushing a transverse cylinder in said longitudinal cross member adapted to receive a first and second piston, said first piston connected to said first rod assembly, said second piston connected to said second rod assembly, said pistons defining a first slot at right angles to said rod assembly and a second deeper slot parallel to said rod assembly, said first and second said slots adapted to retain said pivoting toggle assembly when the rods are in the ambient temperature condition and to release said rods when the rod assembly has been heated to a elevated temperature.

7. The pyrotechnic free release system of claim 1 including a captive ball assembly including a captive piston, said captive piston operably connected to said rod assembly, said captive piston adapted to retain a device in a stowed position when the rod assemblies are in the ambient temperature condition and to release said device when the rod assembly is heated to an elevated temperature.

* * * * *